US008926043B2

(12) United States Patent
Mizutani

(10) Patent No.: US 8,926,043 B2
(45) Date of Patent: Jan. 6, 2015

(54) INK JET PRINTING APPARATUS AND INK JET PRINTING METHOD UTILIZING INK AND PROCESS LIQUID

(75) Inventor: Michinari Mizutani, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 87 days.

(21) Appl. No.: 12/898,982

(22) Filed: Oct. 6, 2010

(65) Prior Publication Data

US 2011/0096115 A1 Apr. 28, 2011

(30) Foreign Application Priority Data

Oct. 28, 2009 (JP) ..... 2009-247772

(51) Int. Cl.
*B41J 29/38* (2006.01)
*B41J 2/21* (2006.01)
*B41J 2/175* (2006.01)

(52) U.S. Cl.
CPC ..... *B41J 2/1753* (2013.01); *B41J 2/2114* (2013.01); *B41J 29/38* (2013.01)
USPC ..... 347/14

(58) Field of Classification Search
None
See application file for complete search history.

(56) References Cited

U.S. PATENT DOCUMENTS 5,838,340 A * 11/1998 Shimoda ..... 347/14
6,325,502 B1 * 12/2001 Shioya et al. ..... 347/101
6,435,639 B1 * 8/2002 Nakajima et al. ..... 347/15
2007/0064026 A1 * 3/2007 Hirakawa ..... 347/6

FOREIGN PATENT DOCUMENTS

JP 11-309882 A 11/1999
JP 2006-192597 A 7/2006
JP 2006192597 A * 7/2006
JP 2006-231602 A 9/2006

OTHER PUBLICATIONS

Office Action dated Sep. 17, 2013, in Japanese Application No. 2009-247772.

* cited by examiner

*Primary Examiner* — Geoffrey Mruk
*Assistant Examiner* — Bradley Thies
(74) *Attorney, Agent, or Firm* — Fitzpatrick, Cella, Harper & Scinto

(57) ABSTRACT

The present invention provides an ink jet printing apparatus and an ink jet printing method in which if an image is printed using ink and a process liquid serving to improve the printability of the ink, degradation of print image quality can be suppressed which results from a rise in the temperature of a print head. To achieve this, the present invention reduces the amount of process liquid ejected from a process liquid ejection section capable of ejecting a process liquid, with increasing temperature of an ink ejection section capable of ejecting ink.

22 Claims, 11 Drawing Sheets

| HEAD TEMPERATURE (INK TEMPERATURE) | 15 ℃ | 20 ℃ | 25 ℃ | 30 ℃ | 35 ℃ | 40 ℃ | 45 ℃ | 50 ℃ | 55 ℃ | 60 ℃ |
|---|---|---|---|---|---|---|---|---|---|---|
| INK PRINT DUTY | 100 % | ← | ← | ← | ← | ← | ← | ← | ← | ← |
| PROCESS LIQUID APPLICATION DUTY | 100 % | 93.75 % | 87.50 % | 81.25 % | 75 % | 68.75 % | 62.50 % | 56.75 % | 50 % | 43.75 % |

FIG.7A

| HEAD TEMPERATURE (INK TEMPERATURE) | 15 ℃ | 20 ℃ | 25 ℃ | 30 ℃ | 35 ℃ | 40 ℃ | 45 ℃ | 50 ℃ | 55 ℃ | 60 ℃ |
|---|---|---|---|---|---|---|---|---|---|---|
| INK PRINT DUTY | 100 % | ← | ← | ← | ← | ← | ← | ← | ← | ← |
| PROCESS LIQUID APPLICATION DUTY | 50 % | ← | ← | ← | ← | ← | ← | ← | ← | ← |
| PROCESS LIQUID PULSE TABLE NO. | 1 | 2 | 3 | 4 | 5 | 6 | 7 | 8 | 9 | 10 |

FIG.7B

INK JET PRINTING APPARATUS AND INK JET PRINTING METHOD UTILIZING INK AND PROCESS LIQUID

BACKGROUND OF THE INVENTION

1. Field of the Invention

The present invention relates to an ink jet printing apparatus and an ink jet printing method in which printing is performed using an ink jet ejection section capable of ejecting an ink based on print data and a process liquid ejection section capable of ejecting a process liquid serving to improve the printability of the ink.

2. Description of the Related Art

A serial scan ink jet printing apparatus prints an image on a print medium by repeating an operation of moving a print head in a main scanning direction, while ejecting an ink from the print head, and an operation of conveying the print medium in a sub-scanning direction crossing the main scanning direction. The print head includes a large number of nozzles formed therein to eject the ink. When the image is printed, the ink is ejected through nozzles corresponding to image data.

Japanese Patent Laid-Open No. H11-309882 (1999) describes a printing apparatus in which a print head ejects not only an ink but also a process liquid so that the process liquid serves to improve the printability of the ink. The printing apparatus is configured to thin out (cull) locations on a print medium to which the process liquid is to be applied when the printing density of the ink has at least a predetermined value, in order to avoid applying more process liquid than required to prevent an increase in running costs and image degradation associated with cockling or beading.

In the ink jet printing apparatus, the ejection amount of the ink or process liquid is likely to vary depending on the temperature of the print head. A variation in ejection amount may lead to degradation of image quality (a variation in density or an uneven density). In particular, if the number of ink ejections (the number of ink dots formed) per unit print area on the print medium is large, the temperature of the print head is likely to rise to increase the ejection amounts of the ink and the process liquid. Thus, the image quality is likely to be degraded. Furthermore, in the serial scan printing apparatus, if a print range per scan is large and if the print head has a high scan speed, the temperature of the print rises sharply during the scan. Thus, similarly, the image quality is likely to be degraded.

SUMMARY OF THE INVENTION

The present invention provides an ink jet printing apparatus and an ink jet printing method in which if an image is printed using an ink and a process liquid serving to improve the printability of the ink, degradation of print image quality, which can result from a rise in the temperature of the print head, can be prevented.

In the first aspect of the present invention, there is provided an ink jet printing apparatus configured to print an image on a print medium using an ink ejection section capable of ejecting an ink containing a color material and a process liquid ejection section capable of ejecting a process liquid for coagulating or insolubilizing the color material, the ink jet printing apparatus comprising: a control unit configured to reduce an amount of the process liquid ejected from the process liquid ejection section, with increasing temperature of the ink ejection section.

In the second aspect of the present invention, there is provided an ink jet printing method of performing printing using an ink ejection section capable of ejecting ink containing a color material and a process liquid ejection section capable of ejecting a process liquid for coagulating or insolubilizing the color material, the ink jet printing method comprising: a step of reducing an amount of the process liquid ejected from the process liquid ejection section, with increasing temperature of the ink ejection section.

According to the present invention, the ejection amount of the process liquid is reduced with increasing temperature of the ink ejection section. Thus, if the temperature of the ink ejection section rises to increase the ejection amount of the ink, the ejection amount of the process liquid can be reduced to allow the ink to sink easily into the print medium. As a result, even if the ejection amount of the ink increases with a rise in the temperature of the ink ejection section, an increase in print density can be suppressed.

Further features of the present invention will become apparent from the following description of exemplary embodiments (with reference to the attached drawings).

BRIEF DESCRIPTION OF THE DRAWINGS

FIG. 7A is a diagram illustrating the application amount of the process liquid varied according to the first embodiment of the present invention, and FIG. 7B is a diagram illustrating a driving pulse for a process liquid print head selected according to a second embodiment of the present invention;

DESCRIPTION OF THE EMBODIMENTS

Embodiments of the present invention will be described below with reference to the accompanying drawings.

First Embodiment

Figure 1:
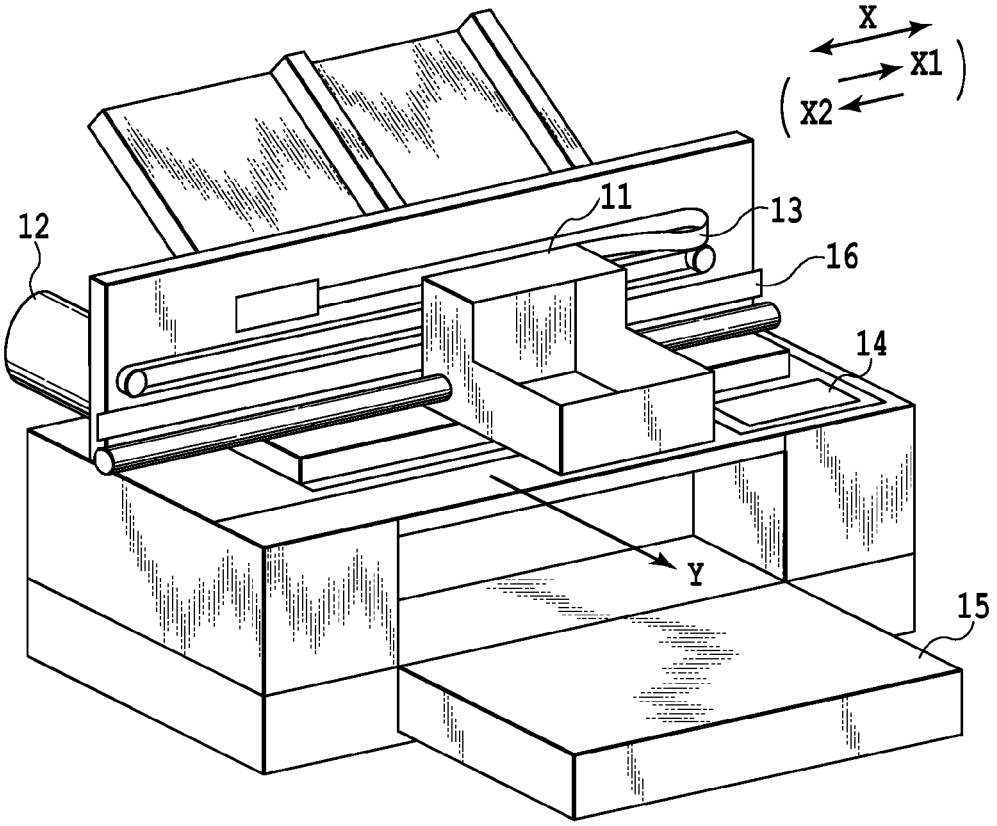
FIG. 1 is a schematic perspective view of an ink jet printing apparatus to which the present invention is applicable.

FIG. 1 shows the appearance of an ink jet printing apparatus to which the present invention is applicable.

Figure 2:
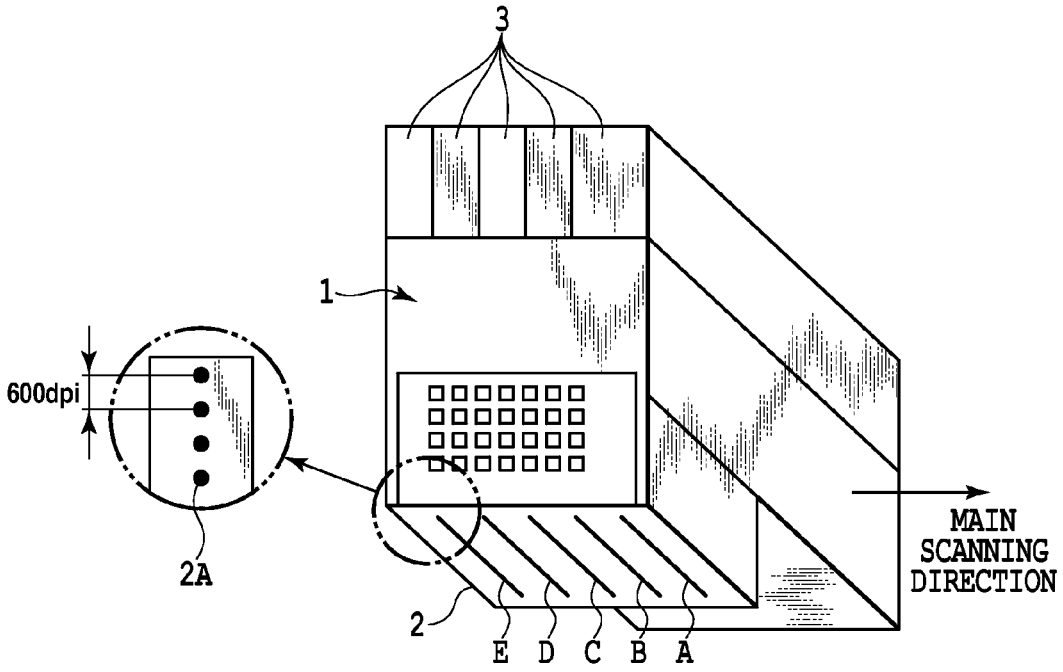
FIG. 2 is a perspective view of an ink jet cartridge that can be mounted in the ink jet printing apparatus in FIG. 1.

The printing apparatus in the present example includes a carriage 11 on which an ink jet cartridge 1 (see FIG. 2) is mounted, and a carriage driving motor 12 configured to reciprocate the carriage 11 in a main scanning direction shown by arrow X. The ink jet cartridge 1 is a combination of an ink jet print head 2 and ink tanks 3. The ink tanks 3 are replaceable, and the print head 2 need not form the ink jet cartridge together with the ink tanks 3. In the present example, five nozzle rows A to E are formed in the print head 2. In each of the nozzle rows, 256 nozzles 2A are arranged at a pitch of 600 dpi.

A process liquid is ejected through the nozzle row A forming a process liquid ejection section. Black (K) ink, cyan (C) ink, magenta (M) ink, and yellow (Y) ink are ejected through the nozzle rows B, C, D, and E, respectively. The process liquid improves the printability of the ink. For example, the process liquid may contain a component that coagulates or insolubilizes the ink or a color material in the ink on a print medium. Five ink tanks 3 are replaceably provided to accommodate the process liquid and the color ink in each of C, M, Y, and K. The process liquid and the color ink are thus supplied to the print head 2. The print head 2 can eject the process liquid and the ink using ejection energy generation elements such as electrothermal conversion elements (heaters) or piezoelectric elements. If the electrothermal conversion elements are used, heat from the electrothermal conversion elements allows the process liquid and the ink to be bubbled. The resultant bubbling energy can be utilized to eject the process liquid and the ink through ejection ports at the tips of the nozzles 2A.

An electric signal from a control section (not shown in the drawings) provided in the printing apparatus is transmitted to the ink jet cartridge 1 through a flexible cable 13. Furthermore, the printing apparatus includes recovery means 14 for recovering the print head 2, a sheet feeding tray 15 on which print media such as paper are stacked, and an optical position sensor 16 configured to optically read the moving position of the carriage 11. The print medium is conveyed by a conveying mechanism such as a conveying roller in a sub-scanning direction crossing the main scanning direction (in the present example, orthogonal to the main scanning direction) as shown by arrow Y.

The printing apparatus configured as described above sequentially prints images on the print medium by repeating an operation of moving the carriage 11 in the main scanning direction, while ejecting the process liquid and the ink through the nozzles 2A in the print head 2, and an operation of conveying the print medium in the sub-scanning direction.

Figure 3:
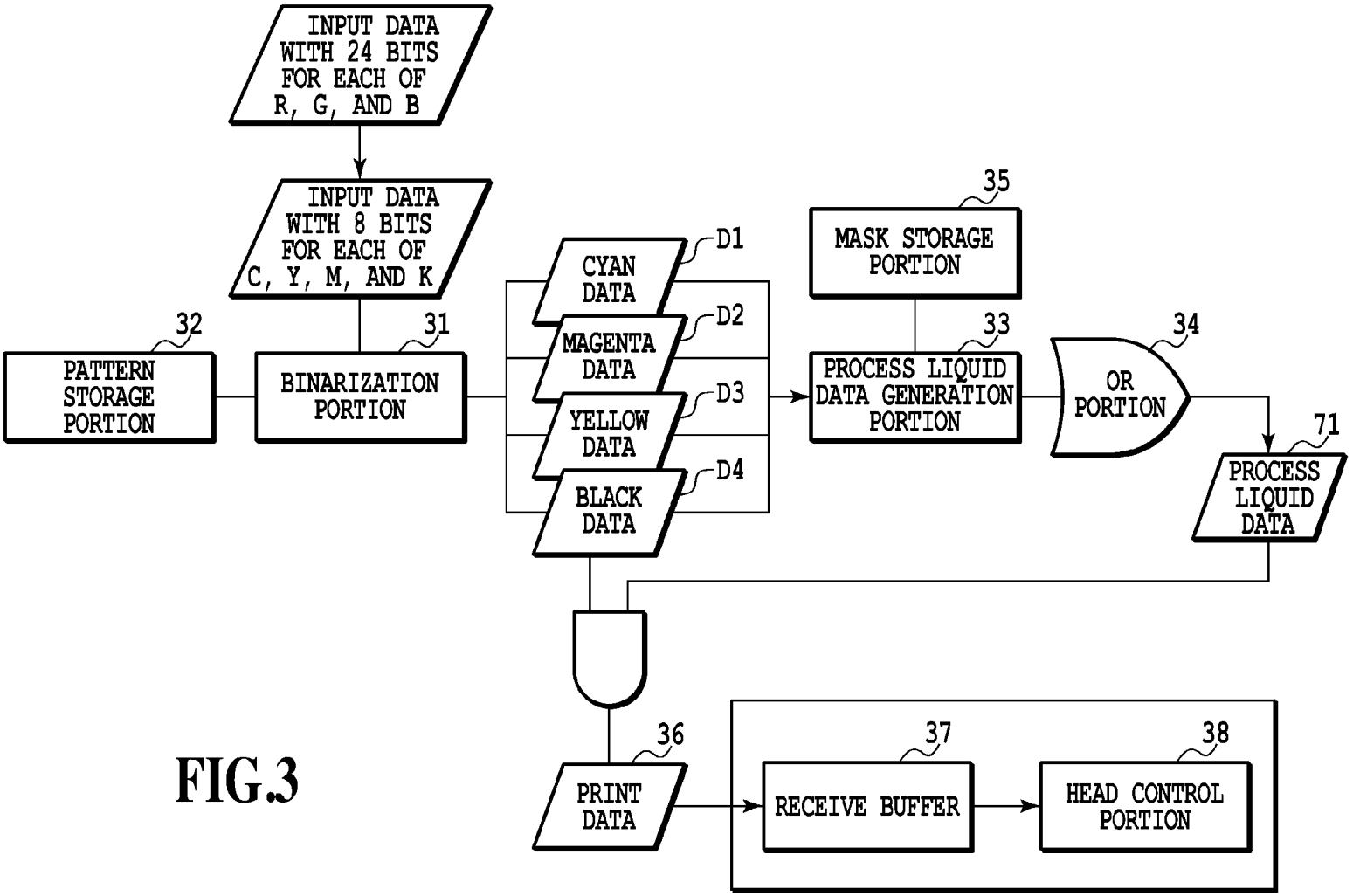
FIG. 3 is a block diagram of a data processing system in an ink jet printing apparatus according to a first embodiment of the present invention.

FIG. 3 is a block diagram of a control system for the printing apparatus. A binarization portion 31 expands multi-valued input data (image data) into binary bit maps (data D1 to data D4) corresponding to the ink in the respective colors (C, M, Y, and K) based on patterns stored in a storage portion 32. In the present example, input data with 8 bits for each of colors R, G, and B and with a resolution of 600 DPI is converted into data with 8 bits for each of colors C, M, Y, and K and with a resolution of 600 DPI by means of luminance density conversion and color processing. The binarization portion 31 expands the data with 8 bits for each of the C, M, Y, and K into 600-DPI binary bit map data D1, D2, D3, and D4 corresponding to the respective ink colors. Based on the data D1, D2, D3, and D4 for the ink in the respective colors, a liquid data generation portion 33 uses a mask stored in a mask storage portion 35 to generate data for the process liquid corresponding to each type of color ink. An OR portion 34 calculates the logical sum of the data for the process liquid corresponding to the ink in the respective colors to complete data 71 for the process liquid. The data D1, D2, D3, and D4 for the respective colors and the data 71 for the process liquid are generated into print data 36, which is received by a receive buffer 37. Based on the print data 36, a head control portion 38 drives the print head 2.

Processing for generating the print data 36 is normally executed by a host computer (host apparatus). The printing apparatus includes the receive buffer 37 and the head control portion 38.

In the description below, a one-pass bidirectional printing scheme is carried out. According to the one-pass bidirectional printing scheme, the print head is allowed to scan a predetermined print area on a print medium once to complete printing an image. In this scheme, printing (bidirectional printing) is performed when the print head moves forward (the direction shown by arrow X1) and backward (the direction shown by arrow X2). Furthermore, as an example in which the temperature of the print head rises sharply, the case will be described where a high-print-duty image (for example, a solid image that is continuous in the main scanning direction) with a large number of ink ejections (a large number of ink dots formed) per unit print area is continuously printed by the bidirectional printing.

Figure 4:
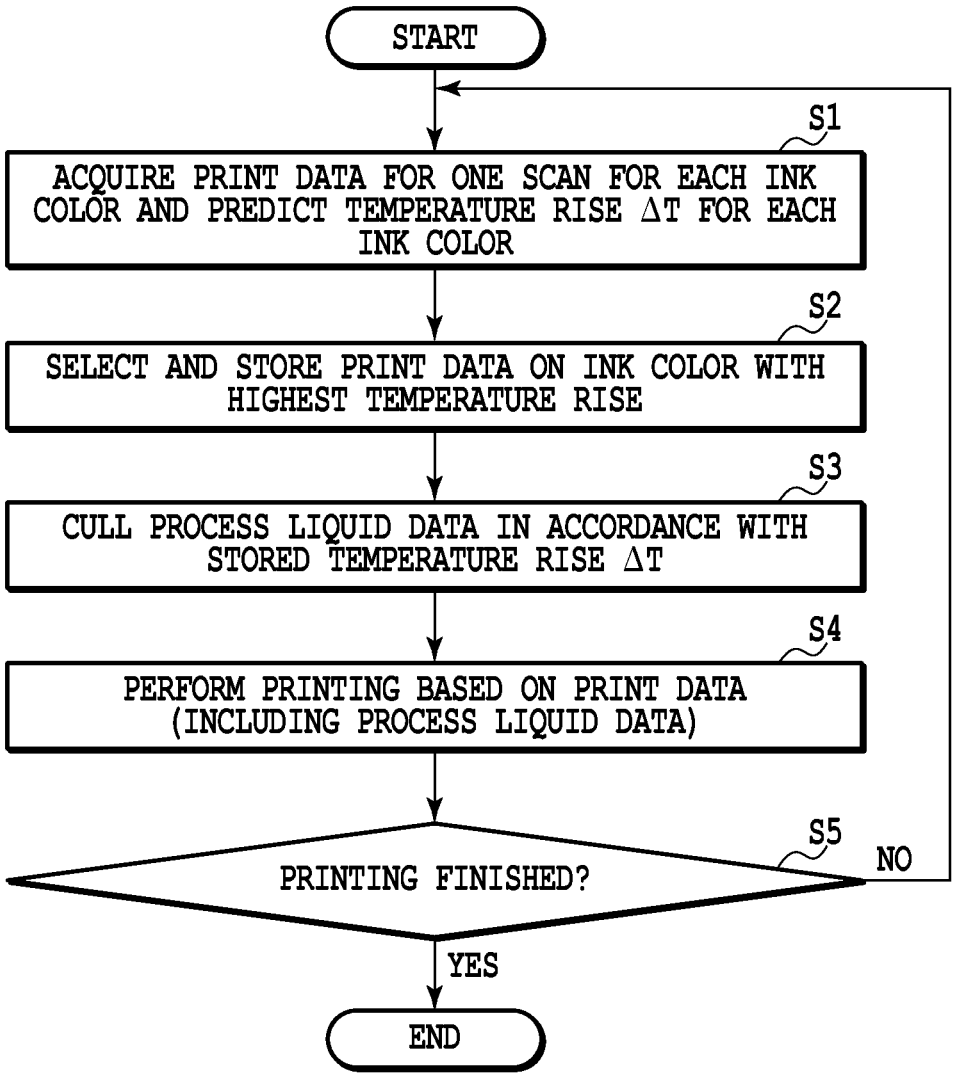
FIG. 4 is a flowchart illustrating a printing operation in the first embodiment of the present invention.

FIG. 4 is a flowchart showing the flow of a print control process according to the present embodiment. In this process, print data for one band is acquired, and a printing operation is performed based on the print data.

First, in step S1, one band of print data for each of the ink colors (C, M, Y, and K) is read from a print buffer in the printing apparatus in which the print data 36 is stored. Based on the print data, a temperature rise $\Delta T$ is predicted as follows. Print data for one scan is required to allow the print head to eject the ink and the process liquid during a single movement of the print head in the main scanning direction.

Figure 5:
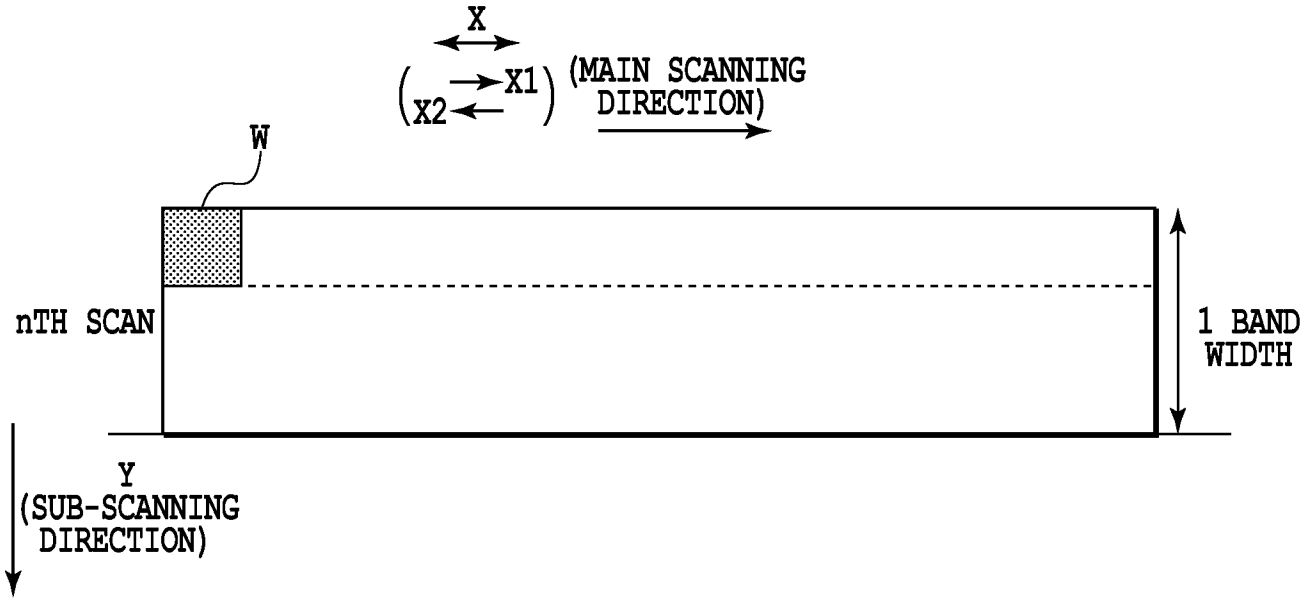
FIG. 5 is a diagram illustrating a divided area for print data in the first embodiment of the present invention.

First, the number of data (which corresponds to the number of ink dots formed) indicative of ink ejection is counted for each ink color. A print duty per unit area during one scan (the number of ink ejections per unit print area) is then calculated for each ink color. The print data is counted (dot count) for each divided area W as shown in FIG. 5. That is, one band of print data to be printed on the print medium is divided into pieces in the main scanning direction and the sub-scanning direction. The resultant areas (divided areas) W are defined as dot count areas. The number of dots formed in each dot count area is counted. The size of the dot count area is, for example, an area corresponding to 16×16 dots. The numbers of dots in the dot count areas are added together to calculate the total number of dots in one band of print data. The total number of dots is calculated for the print data for each ink color.

Based on the calculated value of the total dot number, a variation in the temperature of the print head is simulated which is observed when printing is actually performed based on the print data. Thus, the temperature rise $\Delta T$ by which the temperature is raised during one scan for each ink color is predicted. If the ejection energy generation elements provided in the print head are electrothermal conversion elements, the total dot number for each scan corresponds to the number of times that the electrothermal element is driven during one scan (Hs(i)). Furthermore, in addition to the total dot number for each scan, print time (ts(i)) dependent on a scan distance may be referenced to predict the temperature rise $\Delta T$.

Thus, in step S1, the temperature rise $\Delta T$ during one scan for each ink color is determined. In the next step S2, the print data for the ink color with the highest temperature rise $\Delta T$ is selected and stored in a storage section (RAM or the like) in the printing apparatus. In step S3, the process liquid data is culled in accordance with the temperature rise ΔT.

In the next step S4, based on the print data including the process liquid data, the print head 2 ejects the process liquid and the ink in each color to print an image. In the present example, a "pre-application" scheme is adopted in which the process liquid is ejected before the ink in each color is ejected. Alternatively, a "post-application" scheme may be adopted in which after the ink in each color is ejected, the process liquid is ejected. In the next step S5, the apparatus determines whether or not the printing operation based on the print data has been finished. If the printing operation fails to have finished, the process returns in step S1. When the printing operation is finished, the process is terminated.

Figure 6A:
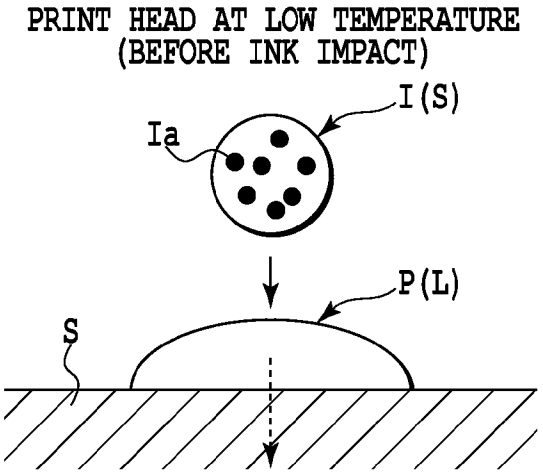
FIG. 6A to FIG. 6D are diagrams illustrating the relationship between an ink and a process liquid both applied to a print medium when a print head is at a low temperature and when the print head is at a high temperature, according to the first embodiment of the present invention.
Figure 6C:
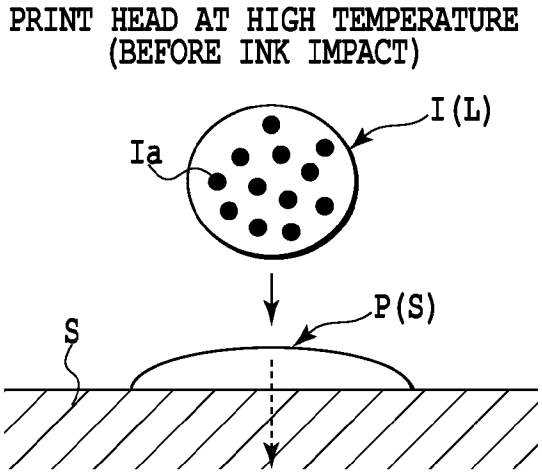
Figure 6B:
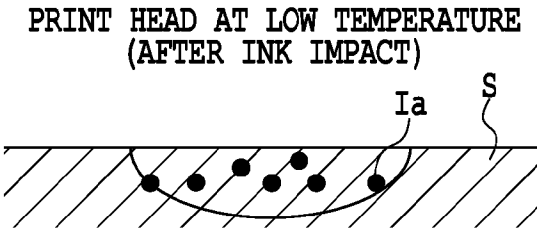
Figure 6D:
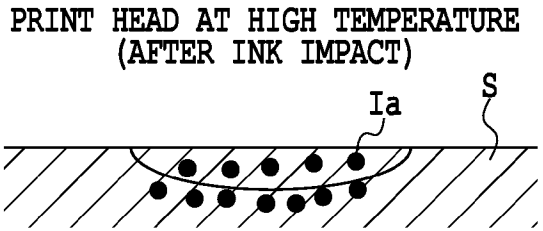

FIGS. 6A and 6B are schematic diagrams showing droplets of the ink and process liquid observed when the print head has a low temperature. FIGS. 6C and 6D are schematic diagrams showing droplets of the ink and process liquid observed when the print head has a high temperature. In general, when the temperature of the print head is between 15° C. and 60° C., the ejection amount of the ink increases at a constant rate consistently with the temperature. In the present example, as the ejection amount of the ink increases as a result of a rise in the temperature of the print head, the process liquid data is culled so as to reduce the ejection amount of the process liquid. For example, during a low temperature period when a small amount of ink I(S) is ejected, a large amount of process liquid P(L) is ejected to reduce the degree of permeation of the ink through a print medium S as shown in FIG. 6A. On the other hand, during a high temperature period when a large amount of ink I(L) is ejected, a small amount of process liquid P(S) is ejected to increase the degree of permeation of the ink through the print medium S as shown in FIG. 6C. Thus, during one scan, if the ejection amount of the ink increases consistently with the temperature of the print head, the amount of process liquid decreases with increasing ejection amount of the ink. Hence, as the ejection amount of the ink increases, the color material Ia of the ink sinks more deeply into the print medium S. This prevents the image density on the print medium from increasing. In the present example, the process liquid data is pre-culled to make the image density of the ink almost constant regardless of the temperature. An increase in image density can be suppressed in spite of a rise in the temperature of the print head.

Figure 8:
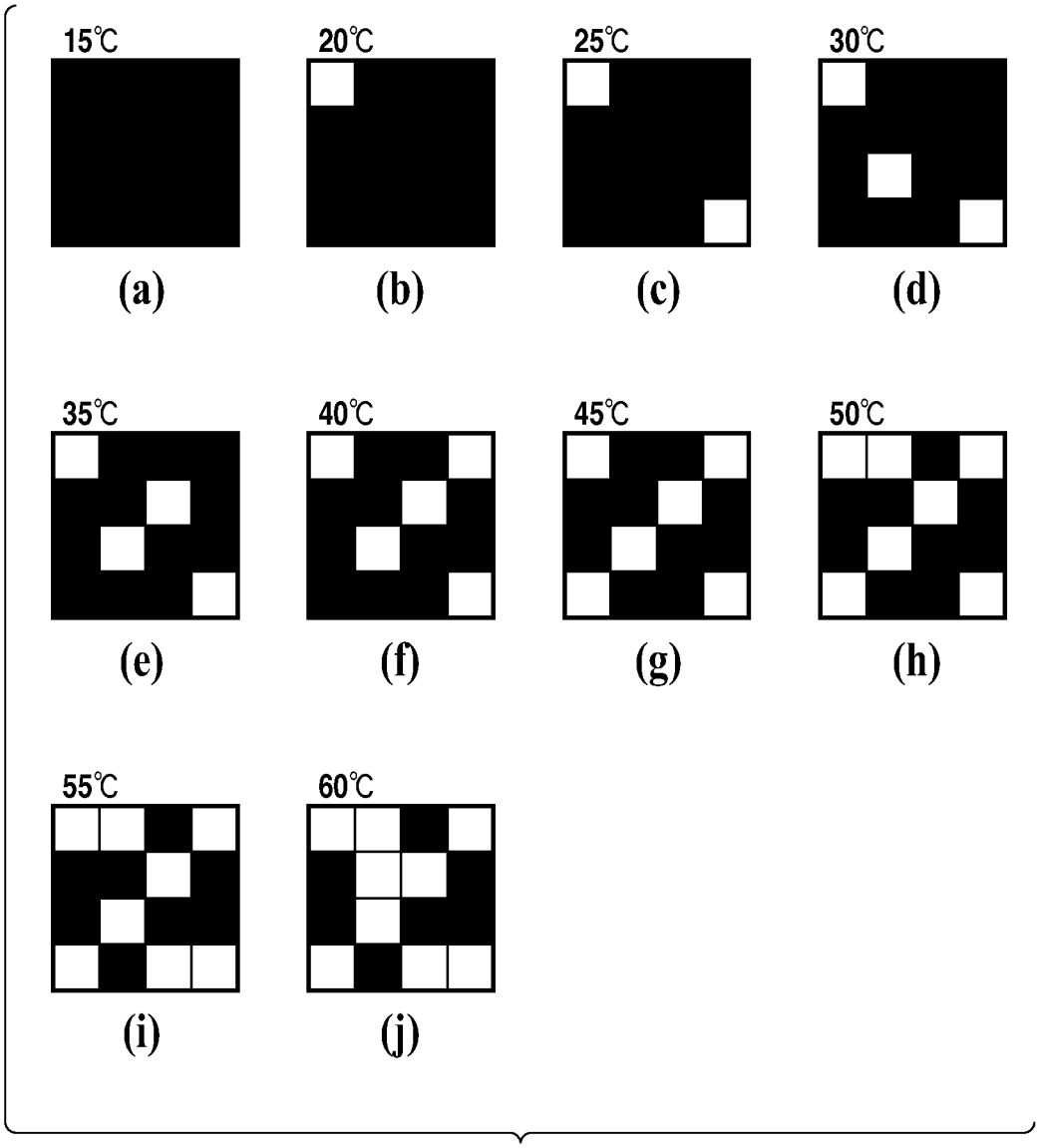
FIG. 8 is a diagram illustrating a mask for process liquid data culling according to the first embodiment of the present invention.

FIG. 7A is a diagram illustrating the temperature of the print head (substantially the ink temperature in the print head) and the application duty of the process liquid (the number of process liquid ejections per unit print area). In the present example, print data for the ink color with the highest temperature rise ΔT allows a solid image with a print duty of 100% to be continuously printed during one scan. The print data causes the largest rise in the temperature of the print head. As the temperature of the print head increases, the culling rate of the process liquid data is increased so as to reduce the application duty of the process liquid. In FIG. 8, (a) to (j) are diagrams illustrating the relationship between the temperature of the print head and a mask pattern required to cull (thin out) the process liquid data. The use of such a mask pattern enables an increase in the culling rate of the process liquid data consistent with the temperature of the print head.

In the present example, the temperature of the print head is predicted based on the print data for one scan. Then, the culling rate of the process liquid data is increased so as to reduce the ejection amount of the process liquid consistently with increasing predicted temperature. The temperature of the print head tends to rise from the beginning toward the end of printing during one scan. Thus, desirably, the temperature of the print head is predicted for each predetermined area (for example, each divided area W) so that the ejection amount of the process liquid can be controlled based on the predicted temperature. Hence, if the predicted temperature of the print head rises gradually during one scan, the ejection amount of the process liquid can be reduced in a stepwise fashion during the scan. Furthermore, the period during which the ejection amount of the process liquid is reduced may be only the latter half of one scan when the temperature of the print head rises.

Second Embodiment

Figure 9:
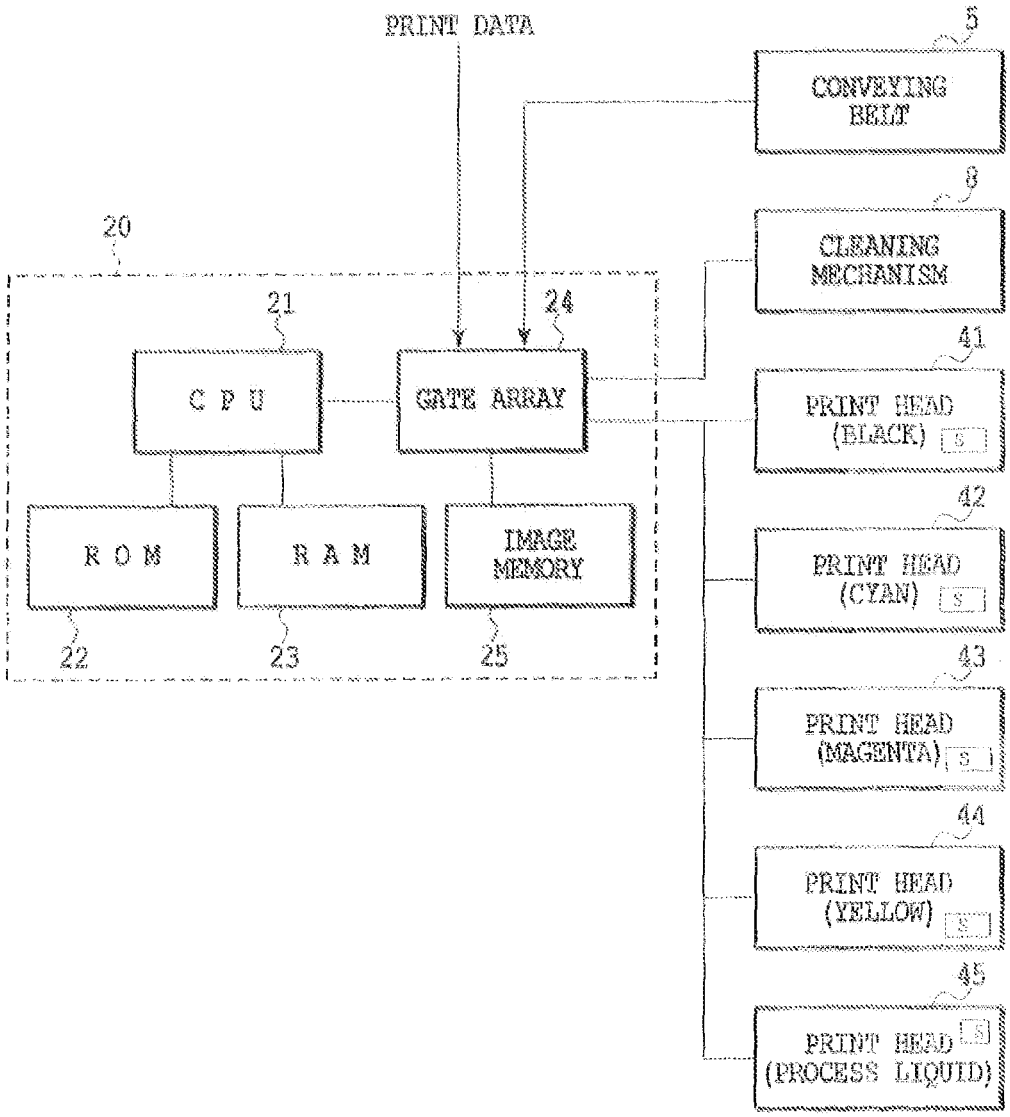
FIG. 9 is a block diagram of a control system of an ink jet printing apparatus according to the second embodiment of the present invention.

FIG. 9 is a block diagram of a control system for an ink jet printing apparatus according to the present embodiment. Reference numerals 41, 42, and 43 denote a black ink ejection print head, a cyan ink ejection print head, and a magenta ink ejection print head, respectively. Reference numerals 44 and 45 denote a yellow ink ejection print head and a process liquid ejection print head, respectively. The print heads 41 to 44 form an ink ejection section capable of ejecting ink. The print head 45 forms a process liquid ejection section capable of ejecting a process liquid. Nozzles though which the ink in each color and the process liquid are ejected are arranged in each of the print heads in a row. The print heads can be mounted on a carriage in the same manner as that in the above-described embodiment. Each of the print heads in the present example includes electrothermal conversion elements (heaters) as ejection energy generation elements for allowing the ink and the process liquid to be ejected. As described below, a driving pulse (heat pulse) is applied to the electrothermal conversion elements to generate heat from the electrothermal conversion elements. Then, the ink in each color and the process liquid can be bubbled so that the resultant bubbling energy can be utilized to eject the ink in each color and the process liquid through the nozzles.

Reference numeral 5 denotes a conveying belt driving roller configured to convey a print medium. Each of the print heads 41 to 45 includes a temperature sensor S configured to detect the temperature of the print head. The temperature sensor is located near nozzles. Reference numeral 20 denotes a control section including a CPU 21, a ROM 22 in which programs are stored, a RAM 23 to which work data required for control is saved, and a gate array 24. The gate array 24 outputs a driving control signal for the conveying belt driving roller 5, image signals and control signals for the print heads 41 to 45, a driving control signal for a cleaning mechanism 8, value in a pulse width table described below, and the like. Reference numeral 25 denotes an image memory in which print data received by the gate array 24 is temporarily stored.

Figure 10:
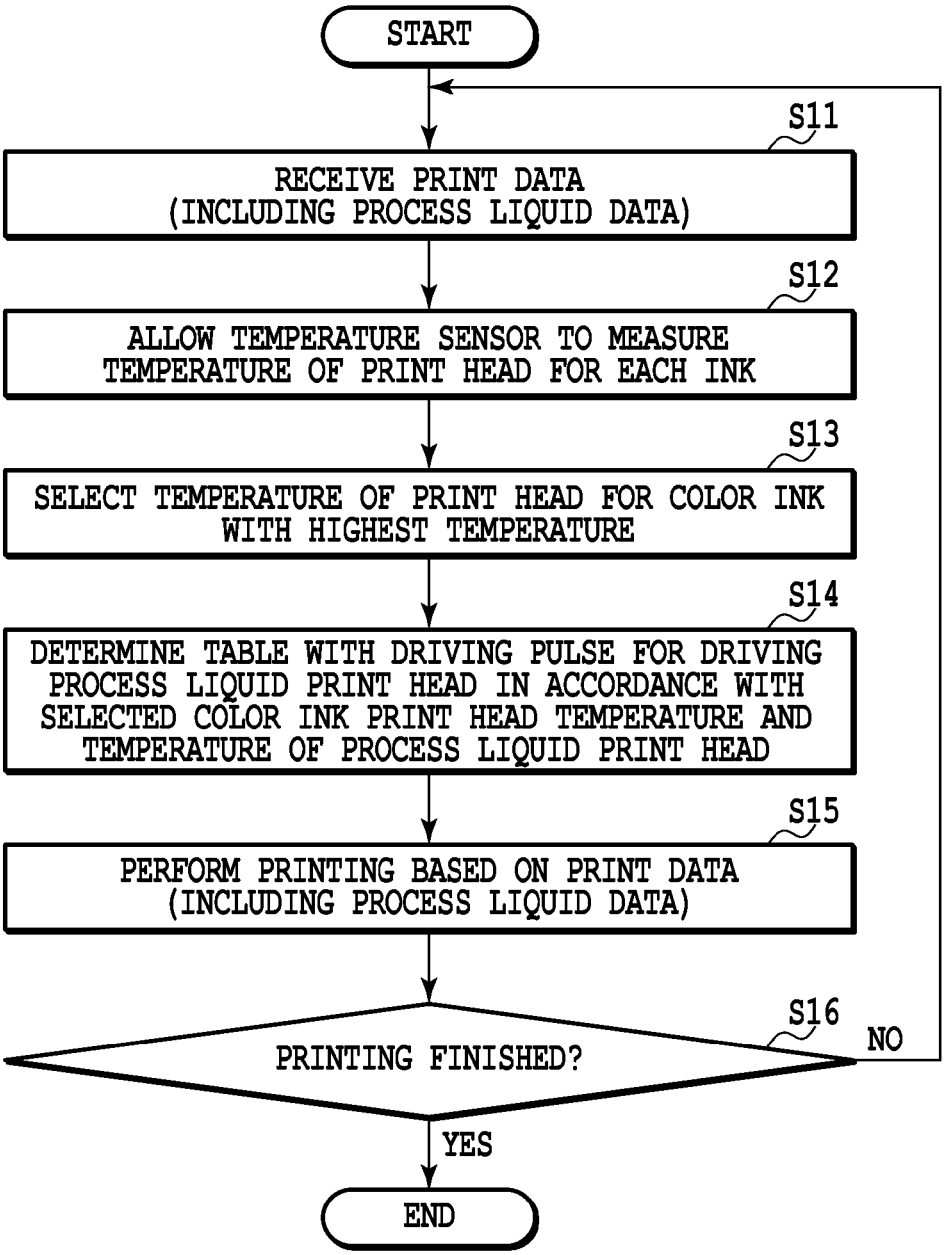
FIG. 10 is a flowchart illustrating a printing operation according to the second embodiment of the present invention.

Now, the present example will be described with reference to the flowchart in FIG. 10. In step S11, image data for one scan for each ink color and process liquid data are received. In the next step S12, the temperature of the print head for each ink color is measured using the temperature sensor. The temperature sensor in the present example is located near a nozzle positioned at an end (end nozzle) of a nozzle row. In step S13, the highest one of the head temperatures sensed by the respective temperature sensors is selected. In step S14, in accordance with the selected print head temperature, a driving pulse for driving the process liquid print head 45 is selected from driving pulse tables No. 1 to No. 10 in FIG. 11 as described below. If an image with a high ink dot formation density is printed on a print medium, when a heat pulse with the same pulse width is applied to allow ink to be repeatedly ejected, the temperature of the print head rises gradually. Then, the ejection amount of the ink increases, possibly resulting in an increase in the density of the image.

In the next step S14, based on print data including process liquid data, the print heads eject the process liquid and the ink in each color to print an image. Like the above-described embodiment, the present embodiment adopts the "post-application" scheme in which after the process liquid is ejected, the ink in each color is ejected (see FIGS. 6A to 6D). In the next step S15, the apparatus determines whether or not the printing operation based on the print data has been finished. If the printing operation has not been finished, the process returns to step S11. If the printing operation is finished, the process is terminated.

FIG. 7B is a diagram showing the relationship between the temperature of the print head (substantially the ink temperature in the print head) and the application duty of the process liquid (the number of process liquid ejections per unit print area) and the driving pulse table No. for the process liquid print head 45. Such a relationship is written to the ROM 22 or the like in the printing apparatus main body. In the present example, print data on the ink ejected from the print head with the highest temperature allows a solid image with a print duty of 100% to be continuously printed during one scan. The print data maximizes the temperature of the print head. The ink has a print duty of 100% regardless of the temperature of the print head. The application duty of the process liquid is 50% regardless of the temperature of the print head. A driving pulse for the process liquid print head 45 is selected from the driving pulse tables No. 1 to No. 10 in FIG. 11 so that the application amount of the process liquid decreases with increasing temperature of the print head.

Figure 11:
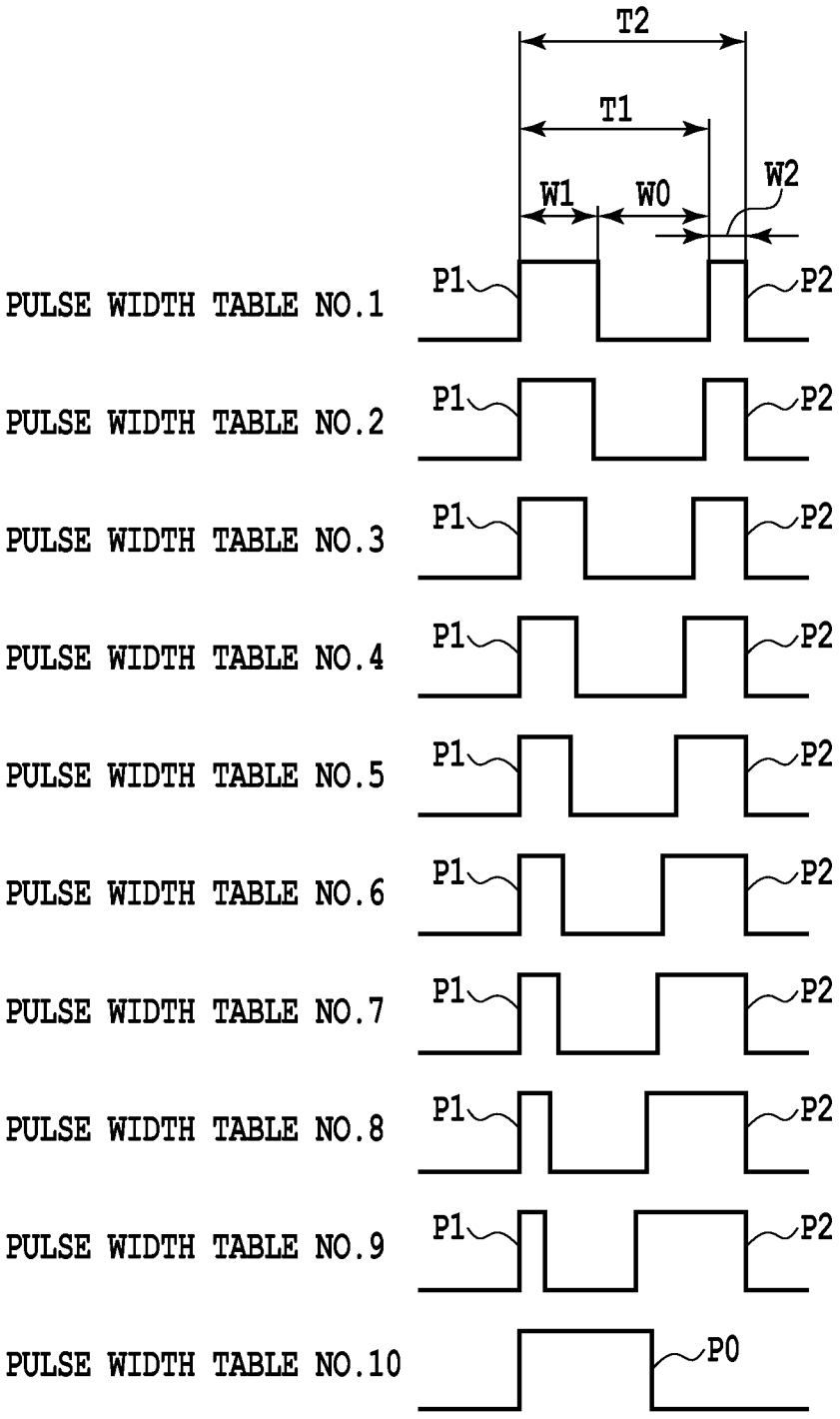
FIG. 11 is a diagram illustrating a driving pulse for a process liquid print head according to the second embodiment of the present invention.

In FIG. 11, W1 denotes the pulse width of a preheat pulse P1. W2 denotes the pulse width of a main heat pulse P2. An interval of width W0 is set between these heat pulses. In the present example, a double pulse driving scheme is adopted in which such heat pulses P1 and P2 are applied to the electrothermal conversion elements, which thus generate heat. The preheat pulse P1 provides a function to mainly preheat the ink and process liquid to be ejected. The main heat pulse P2 provides a function to mainly bubble and eject the ink and process liquid. The width W1 of the preheat pulse P1 decreases and the width W2 of the main heat pulse P2 increases, in order of the tables No. 1 to No. 9. In the table No. 10, the interval width W0 is "0", indicating that the electrothermal conversion elements are driven by a single pulse. The amounts of ink and process liquid ejected by the application of driving pulses decrease in order of the tables No. 1 to No. 10.

In the present example, in connection with an increase in the ejection amount of the ink consistent with the temperature of the print head during one scan, the table No. is selected such that the ejection amount of the process liquid is reduced with increasing temperature of the print head as shown in FIG. 7B. As a result, as is the case with the above-described first embodiment, an increase in image density can be suppressed in spite of a rise in the temperature of the print head.

In the present example, the temperature of the print head during one scan is measured. Then, the driving pulse for the process liquid print head is selected such that the ejection amount of the process liquid decreases with increasing measured temperature. The temperature of the print head tends to rise from the beginning toward the end of printing during one scan. Thus, desirably, the temperature of the print head is measured in each predetermined area (for example, each divided area W) so that the ejection amount of the process liquid can be controlled based on the measured temperature. Hence, if the predicted temperature of the print head rises gradually during one scan, the ejection amount of the process liquid can be gradually reduced in accordance with the measured temperature. In this case, the ejection amount of the process liquid can be reduced in a stepwise fashion during the scan. Furthermore, the period during which the ejection amount of the process liquid is reduced may be only the latter half of one scan when the temperature of the print head rises.

Other Embodiments

The function to control the ejection amount of the process liquid based on the predicted or measured temperature of the print head may be provided in the ink jet printing apparatus. Alternatively, at least a part of the function may be provided in a host apparatus that supplies print data to the ink jet printing apparatus. Furthermore, the function to predict the temperature of the print head may be provided in either of the ink jet printing apparatus and the host apparatus.

Furthermore, the ejection amount of the process liquid may be controlled using both the temperature of the ink ejection section predicted based on the print data as in the case of the first embodiment and the temperature of the ink ejection section measured as in the case of the second embodiment. Additionally, the method of reducing the number of process liquid ejections with increasing temperature of the ink ejection section as in the case of the first embodiment may be combined with the method of reducing the amount of process liquid ejected during one scan with increasing temperature of the ink ejection section as in the case of the second embodiment. The point is that the ejection amount of the process liquid can be controlled using at least one of the two methods.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-247772, filed Oct. 28, 2009, which is hereby incorporated by reference herein in its entirety.

What is claimed is:

1. A printing control apparatus for printing an image on a print medium using a plurality of printheads, each including an ink ejection section for ejecting an ink containing a color material to a unit area of the print medium, and a process liquid ejection section for ejecting a process liquid, a degree of permeation of the ink into the print medium in the unit area decreasing as an amount of the process liquid ejected to the unit area of the print medium increases, the printing control apparatus comprising:

an obtaining unit configured to obtain information relating to change in a volume of an ink droplet to be ejected from the ink ejection section; and a determining unit configured to determine, based on the information obtained by the obtaining unit, an amount of the process liquid to be ejected from the process liquid ejection section to the unit area of the print medium, wherein the determining unit determines the amount of the process liquid such that the amount of the process liquid in a case where the volume of the ink droplet is greater than a predetermined volume is smaller than that in a case where the volume of the ink droplet is equal to the predetermined volume, so as to increase the degree of permeation of the ink in the case where the volume of the ink droplet is greater than the predetermined volume so as to be more than that in the case where the volume of the ink droplet is equal to the predetermined volume, thereby suppressing a change of a density of the image printed by the ink on the print medium caused by the change of the volume of the ink droplet, the information obtained by the obtaining unit indicates temperatures of the plurality of print heads, and the determining unit determines the amount of the process liquid based on the information indicating the greatest temperature among the temperatures of the plurality of print heads.

2. The printing control apparatus according to claim 1, wherein the determining unit determines the amount of the process liquid such that the amount of the process liquid in the case where the volume of the ink droplet is greater than the predetermined volume is smaller than that in the case where the volume of the ink droplet is equal to the predetermined volume, so as to suppress an increase in a density of the image printed by the ink on the print medium in the case where the volume of the ink droplet is greater than the predetermined volume.

3. The printing control apparatus according to claim 1, wherein the ink ejection sections eject the ink based on ink data, the process liquid ejection section ejects the process liquid based on process liquid data, and the determining unit generates the process liquid data based on the ink data, and determines, based on the information obtained by the obtaining unit, the amount of the process liquid to be ejected from the process liquid ejection section to the unit area based on the process liquid data.

4. The printing control apparatus according to claim 1, wherein the ink ejection sections have a sensor for detecting a temperature of the ink ejection sections, the information obtained by the obtaining unit indicates the temperature detected by the sensor, and the determining unit determines the amount of the process liquid to be ejected such that the amount in a case where the temperature is lower than a predetermined temperature is greater than that in a case where the temperature is equal to the predetermined temperature.

5. The printing control apparatus according to claim 1, wherein the information obtained by the obtaining unit indicates an amount of the ink to be ejected from the ink ejection sections to a predetermined area of the print medium, and the determining unit determines the amount of the process liquid to be ejected such that the amount of the process liquid in the case where the information indicates that the amount of the ink is greater than a predetermined amount is less than that in the case where the information indicates that the amount of the ink is equal to the predetermined amount.

6. The printing control apparatus according to claim 1, wherein the determining unit determines the amount of the process liquid to be ejected such that an amount of the process liquid ejected per one ejection from one nozzle of one of the ink ejection sections to the unit area in the case where the volume of the ink droplet is greater than the predetermined volume is less than that in the case where the volume of the ink droplet is equal to the predetermined volume.

7. The printing control apparatus according to claim 1, wherein the determining unit determines the amount of the process liquid to be ejected such that the number of the droplets of the process liquid ejected to the unit area in the case where the volume of the ink droplet is greater than the predetermined volume is less than that in the case where the volume of the ink droplet is equal to the predetermined volume.

8. The printing control apparatus according to claim 1, wherein the determining unit determines the amount of the process liquid to be ejected such that an amount of the process liquid per droplet ejected to the unit area in the case where the volume of the ink droplet is greater than the predetermined volume is less than that in the case where the volume of the ink droplet is equal to the predetermined volume.

9. The printing control apparatus according to claim 1, wherein the ink ejection sections utilize heat generated by energizing electrothermal conversion elements to eject the ink.

10. The printing control apparatus according to claim 1, further comprising the ink ejection units.

11. The printing control apparatus according to claim 1, wherein the process liquid ejection section ejects the process liquid based on process liquid data, and the process liquid data is culled by using a mask pattern corresponding to the amount of the process liquid determined by the determining unit.

12. A printing control method of performing printing of an image on a print medium using a plurality of printheads, each including an ink ejection section for ejecting an ink containing a color material to a unit area of the print medium, and a process liquid ejection section for ejecting a process liquid, a degree of permeation of the ink into the print medium in the unit area decreasing as an amount of the process liquid ejected to the unit area of the print medium increases, the printing control method comprising the steps of:

obtaining information relating to change in a volume of an ink droplet to be ejected from the ink ejection section; and determining, based on the information obtained in the obtaining step, an amount of the process liquid to be ejected from the process liquid ejection section to the unit area of the print medium, wherein the amount of the process liquid is determined such that the amount of the process liquid in a case where the volume of the ink droplet is greater than a predetermined volume is smaller than that in a case where the volume of the ink droplet is equal to the predetermined volume, so as to increase the degree of permeation of the ink in the case where the volume of the ink droplet is greater than the predetermined volume so as to be more than that in the case where the volume of the ink droplet is equal to the predetermined volume, thereby suppressing a change of a density of the image printed by the ink on the print medium caused by the change of the volume of the ink droplet, the information obtained in the obtaining step indicates temperatures of the plurality of print heads, and in the determining step, the amount of the process liquid is determined based on the information indicating the greatest temperature among the temperatures of the plurality of print heads.

13. The printing control method according to claim 12, wherein the amount of the process liquid is determined such that the amount of the process liquid in the case where the volume of the ink droplet is greater than the predetermined volume is smaller than that in the case where the volume of the ink droplet is equal to the predetermined volume, so as to suppress an increase in a density of the image printed by the ink on the print medium in the case where the volume of the ink droplet is greater than the predetermined volume.

14. The printing control method according to claim 12, wherein the ink is ejected from the ink ejection sections based on ink data, the process liquid is ejected from the process liquid ejection section based on process liquid data, and in the determining step, the process liquid data is generated based on the ink data, and based on the information obtained in the obtaining step, the amount of the process liquid to be ejected from the process liquid ejection section to the unit area is determined based on the process liquid data.

15. The printing control method according to claim 12, wherein the information obtained in the obtaining step indicates the temperature of the ink ejection sections, and in the determining step, the amount of the process liquid to be ejected is determined such that the amount in a case where the temperature is lower than a predetermined temperature is greater than that in a case where the temperature is equal to the predetermined temperature.

16. The printing control method according to claim 12, wherein the information obtained in the obtaining step indicates an amount of the ink to be ejected from the ink ejection sections to a predetermined area of the print medium, and in the determining step, the amount of the process liquid to be ejected is determined such that the amount of the process liquid in the case where the information indicates that the amount of the ink is greater than a predetermined amount is less than that in the case where the information indicates that the amount of the ink is equal to the predetermined amount.

17. The printing control method according to claim 12, wherein in the determining step, the amount of the process liquid to be ejected is determined such that an amount of the process liquid ejected per one ejection from one nozzle of one of the ink ejection sections to the unit area in the case where the volume of the ink droplet is greater than the predetermined volume is less than that in the case where the volume of the ink droplet is equal to the predetermined volume.

18. The printing control method according to claim 12, wherein in the determining step, the amount of the process liquid to be ejected is determined such that the number of the droplets of the process liquid ejected to the unit area in the case where the volume of the ink droplet is greater than the predetermined volume is less than that in the case where the volume of the ink droplet is equal to the predetermined volume.

19. The printing control method according to claim 12, wherein in the determining step, the amount of the process liquid to be ejected is determined such that an amount of the process liquid per droplet ejected to the unit area in the case where the volume of the ink droplet is greater than the predetermined volume is less than that in the case where the volume of the ink droplet is equal to the predetermined volume.

20. The printing control method according to claim 12, wherein the ink ejection sections utilize heat generated by energizing electrothermal conversion elements to eject the ink.

21. The printing control method according to claim 12, wherein the process liquid ejection section ejects the process liquid based on process liquid data, and the process liquid data is culled by using a mask pattern corresponding to the amount of the process liquid determined in the determining step.

22. A printing control apparatus for printing an image on a print medium using a plurality of printheads, each including an ink ejection section for ejecting an ink containing a color material to a unit area of the print medium, and a process liquid ejection section for ejecting a process liquid, a degree of permeation of the ink into the print medium in the unit area decreasing as an amount of the process liquid ejected to the unit area of the print medium increases, the printing control apparatus comprising:

an obtaining unit configured to obtain information relating to change in a volume of an ink droplet to be ejected from the ink ejection section; and a determining unit configured to determine, based on the information obtained by the obtaining unit, an amount of the process liquid to be ejected from the process liquid ejection section to the unit area of the print medium, wherein the determining unit determines the amount of the process liquid such that the amount of the process liquid in a case where the volume of the ink droplet is greater than a predetermined volume is smaller than that in a case where the volume of the ink droplet is equal to the predetermined volume, so as to increase the degree of permeation of the ink in the case where the volume of the ink droplet is greater than the predetermined volume so as to be more than that in the case where the volume of the ink droplet is equal to the predetermined volume, thereby suppressing an increase in a density of the image printed by the ink on the print medium in the case where the volume of the ink droplet is greater than the predetermined volume, the information obtained by the obtaining unit indicates temperatures of the plurality of print heads, and the determining unit determines the amount of the process liquid based on the information indicating the greatest temperature among the temperatures of the plurality of print heads.

* * * * *